US006076838A

United States Patent [19]

Peterson et al.

[11] Patent Number: 6,076,838

[45] Date of Patent: Jun. 20, 2000

[54] MANUALLY OPERATED CREEPER AND BRAKE MECHANISM THEREFOR

[76] Inventors: Terry W. Peterson, 2047 Allen Dr., Auburn, Calif. 95602; James P. Dudley, 1426 41st St., Sacramento, Calif. 95819; Stuart M. Grinstain, 2219 La Lima Way, Sacramento, Calif. 95833

[21] Appl. No.: 09/107,263

[22] Filed: Jun. 30, 1998

[51] Int. Cl.[7] ..... B25H 5/00

[52] U.S. Cl. ..... 280/32.6; 280/32.7; 280/79.11; 188/5; 188/7

[58] Field of Search ..... 280/32.6, 32.7, 280/79.11; 188/5, 7

[56] References Cited

U.S. PATENT DOCUMENTS

| | | | |
|---|---|---|---|
| 1,132,983 | 3/1915 | Shuey . | |
| 1,349,941 | 8/1920 | Broome | 280/32.6 |
| 1,446,945 | 2/1923 | Sunderland | 280/32.6 |
| 2,154,952 | 4/1939 | Mahlock | 280/32.6 |
| 2,246,628 | 6/1941 | Heckman | 280/32.6 |
| 2,942,693 | 6/1960 | Johnson | 280/32.6 |
| 3,361,437 | 1/1968 | Loftis | 280/32.6 |
| 4,244,594 | 1/1981 | Hines | 280/32.6 |
| 4,815,569 | 3/1989 | Norman | 280/32.6 |
| 5,472,219 | 12/1995 | Eckstrum . | |

FOREIGN PATENT DOCUMENTS

| | | | |
|---|---|---|---|
| 154419 | 5/1956 | Sweden | 280/32.6 |

*Primary Examiner*—J. J. Swann
*Assistant Examiner*—James S. McClellan
*Attorney, Agent, or Firm*—Flehr Hohbach Test Albritton & Herbert LLP

[57] ABSTRACT

A creeper (10) including a movable main frame (12) and a pad assembly (40) that is longitudinally movable relative to the frame. Pad assembly (40) includes a set of creeper feet (50) that include slots (54), which each receive a cross bar (22, 24) of the main frame (12). Slot (54) includes an arcuate surface (56) that acts as a cam surface while cross bars (22, 24) act as cam followers to raise and lower pad assembly (40).

10 Claims, 5 Drawing Sheets

MANUALLY OPERATED CREEPER AND BRAKE MECHANISM THEREFOR

TECHNICAL FIELD

The present invention relates to manually operated creepers, which allow for example a mechanic to slide face up underneath a car to perform repairs and maintenance and, more particularly, to an improved braking mechanism for temporarily holding the creeper stationary.

BACKGROUND ART

U.S. Pat. No. 5,472,219 of Eckstrum, entitled "Combination Automotive Creeper and Braking Apparatus Therefore," discloses an automotive creeper structure that includes four vertically movable feet for lifting the wheels of the apparatus off the ground and a pair of longitudinally slidable camming bars that each include ramp sections, which can be moved longitudinally in a manner that engages the feet, displacing them vertically and lifting the creeper apparatus from the ground. A pair of outwardly swingable handles are provided to effectuate longitudinal movement of the carnring bars.

With Eckstrum's disclosed apparatus, the feet and wheels are both mounted to the pad structure of the creeper. The camming bars are slidably carried on the main frame structure. In order to stop and brake the creeper in position, it is necessary to slide the main frame longitudinally relative to the pad structure and with enough force to move the ramp sections past the feet in order to depress the feet downwardly against the ground until the wheels and pad structure are lifted. The camming bars are moved longitudinally by means of a pair of handles that are pivotally secured to both the pad structure and the camming bars and which swing outwardly with enough force to slide the ramps past the feet and lift the entire apparatus. It is believed that this operation is more strenuous then necessary and more demanding than practicable, given the constraints of working beneath a vehicle. In addition, Eckstrum's apparatus includes many different components that complicate manufacture and operation of the apparatus.

The present invention is an attempt to simplify a creeper's design, not only to reduce manufacturing cost, but also to enable easier and quicker operation of the apparatus.

Reference is made to Eckstrum's description of the creeper prior art for a good background discussion of creeper design considerations and prior art attempts at improved creeper apparatus.

DISCLOSURE OF INVENTION

Briefly described, the creeper of the present invention includes a foot mounted to a pad assembly in a position to support the pad assembly upon rengagement with the ground surface, a cam surface associated with one of a frame structure and the pad assembly, and a cam follower associated with the other of the frame structure and the pad assembly. Relative movement of the frame structure and the pad assembly causes engagement of the cam surface and the cam follower, causing the foot to engage the ground surface and sufficiently unweight the frame structure to hold the pad assembly stationary in place. The frame structure includes a set of wheels for movably supporting the frame structure across a ground surface, and the pad assembly is movably coupled to the frame structure and includes a support surface for a person to lie on.

According to an aspect of the invention, the cam surface and cam follower are designed to raise and lower the pad assembly in a manner that the weight of the pad assembly and a person lying thereon act to lower the feet when the cam surface and cam follower are moved relative to one another. Specifically, the cam surface and cam follower are aligned in a manner where the feet are raised when the cam surface and the cam follower are engaged and acting against one another. In this manner, the weight of the pad assembly and the person lying thereon assist in braking the creeper, as opposed to the cam action having to overcome the weight of the person and the pad assembly as with prior art creepers.

According to another aspect of the invention, the frame structure and the pad assembly are movable relative to each other from a first position to a second position, wherein in the first position, the frame structure supports the assembly with the foot of the pad assembly spaced above the ground surface, and in the second position, the foot engages the ground with sufficient force to maintain the pad assembly stationary in position. Prior art creepers typically lift the wheels off the ground, which requires more effort. The creeper of the present invention avoids this by simply unweighting the wheels.

The present invention also comprises just the above described brake device for the creeper apparatus. The brake device can be retrofitted to existing frame and pad assembly creepers where the frame and pad assembly are rigidly secured to one another. All that is required is that the pad assembly be separated from the frame and then movably resecured to the frame by means of the brake device.

The present invention also includes a method of braking a creeper apparatus comprising the steps of moving a pad assembly relative to a frame structure to cause relative longitudinal movement therebetween, providing a foot on the pad assembly that includes a cam surface for engaging a cam follower mounted to the frame structure, and as the pad assembly and frame structure are moved relative to one another, lowering the pad assembly by use of its own weight and the weight of a person lying thereon until the foot engages the ground and sufficiently unweights the frame structure to hold the pad assembly in position.

These and other features, objects, and advantages of the present invention will become apparent from the following description of the best mode for carrying out the invention, when read in conjunction with the accompanying drawings, and the claims, which are all incorporated herein as part of the disclosure of the invention.

BRIEF DESCRIPTION OF THE DRAWINGS

Throughout the several views, like reference numerals refer to like parts, wherein.

BEST MODE OF CARRYING OUT THE INVENTION

Reference will now be made in detail to the preferred embodiments of the invention, examples of which are illustrated in the accompanying drawings. While the invention will be described in conjunction with the preferred embodiments, it will be understood that the described embodiments are not intended to limit the invention specifically to those embodiments. On the contrary, the invention is intended to cover alternatives, modifications and equivalents, which may be included within the spirit and scope of the invention as defined by the appended claims.

Figure 1:
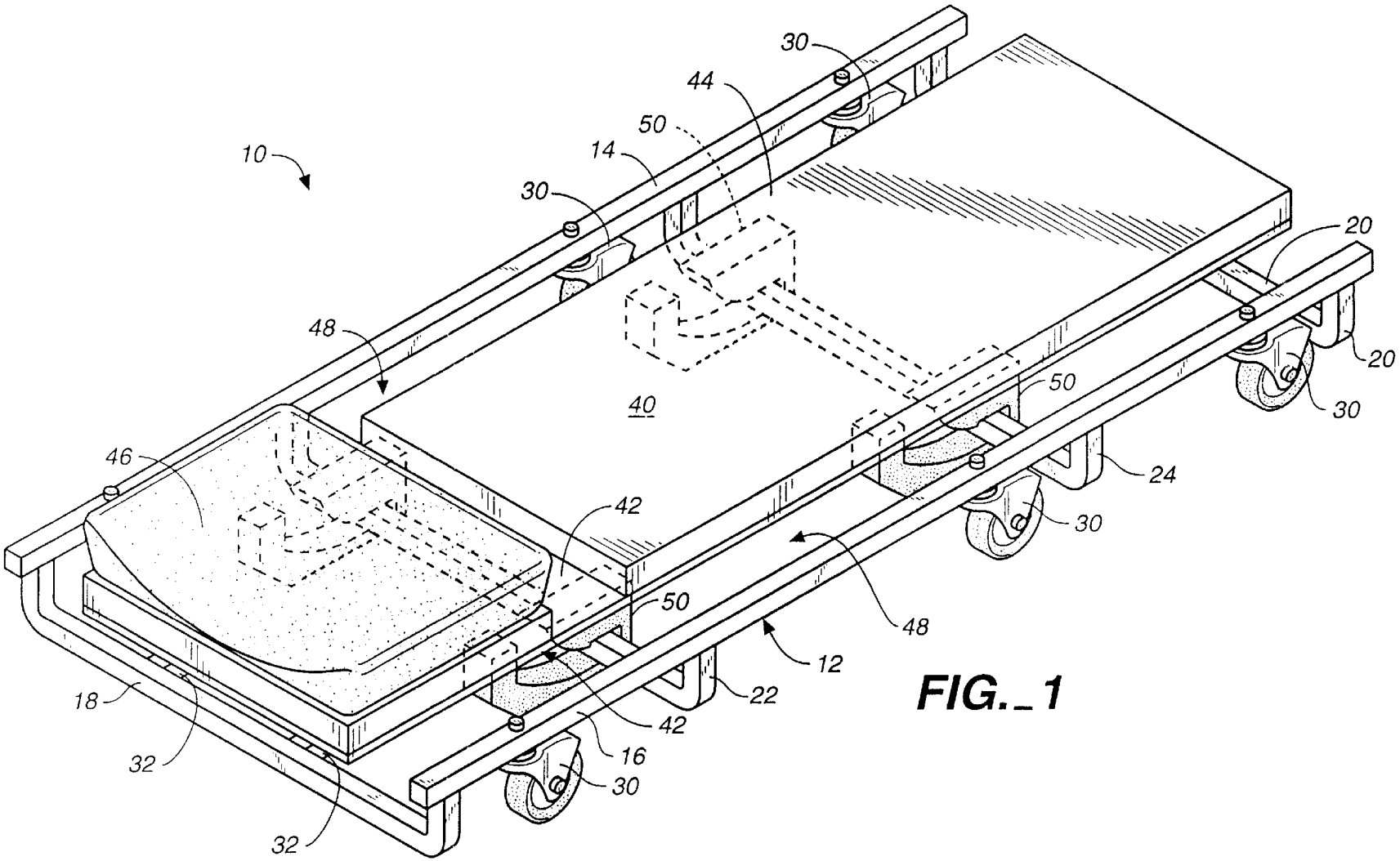
FIG. 1 is a pictorial view of the creeper apparatus of the present invention.
Figure 5:
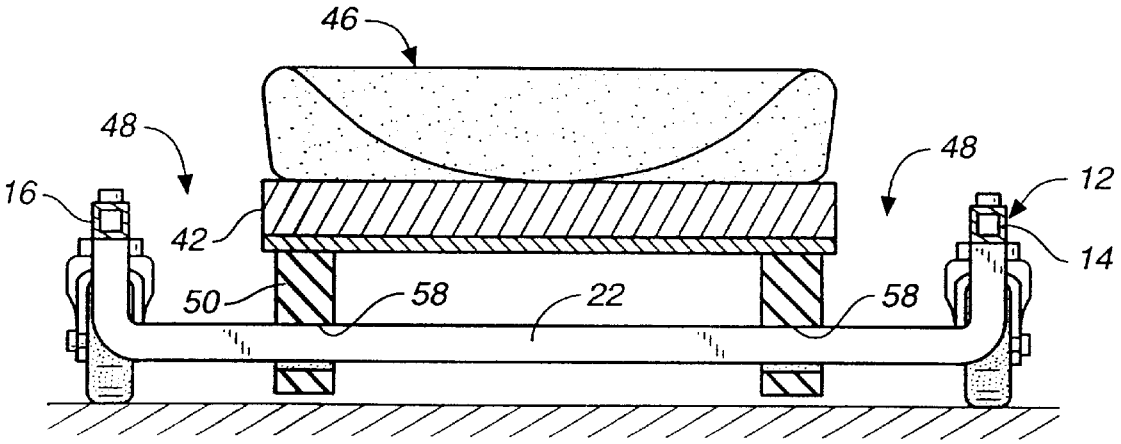
FIG. 5 is an end view of the creeper apparatus of FIG. 1.

Referring to FIG. 1, the present invention comprises a creeper apparatus 10 that includes a rectangular perimeter frame 12 made of square metal tubing and which includes lateral outer side bars 14, 16, end cross bars 18, 20 and a pair of middle cross bars 22, 24. Cross bars 18, 20, 22, 24 are each bent downwardly in a U-shape design (FIG. 5) and are secured to side bars 14, 16 by suitable mechanical fasteners or by welding. A pair of additional short longitudinal reinforcing bars 32 are secured between end bar 18 and cross bar 22. A set of six caster wheels 30 are secured to side bars 14, 16, three to each side bar.

An elongated pad assembly 40 is movably mounted onto cross bars 22, 24 and includes a flat base platform 42 that supports along the majority of its length a body pad 44 and at one end a headrest 46. The length of pad assembly 40 is substantially the same as the length of frame 12 but the width of pad assembly 40 is much narrower so that there are substantial gaps 48 between the side edges of the pad assembly and side bars 14, 16 of the frame.

Figure 2:
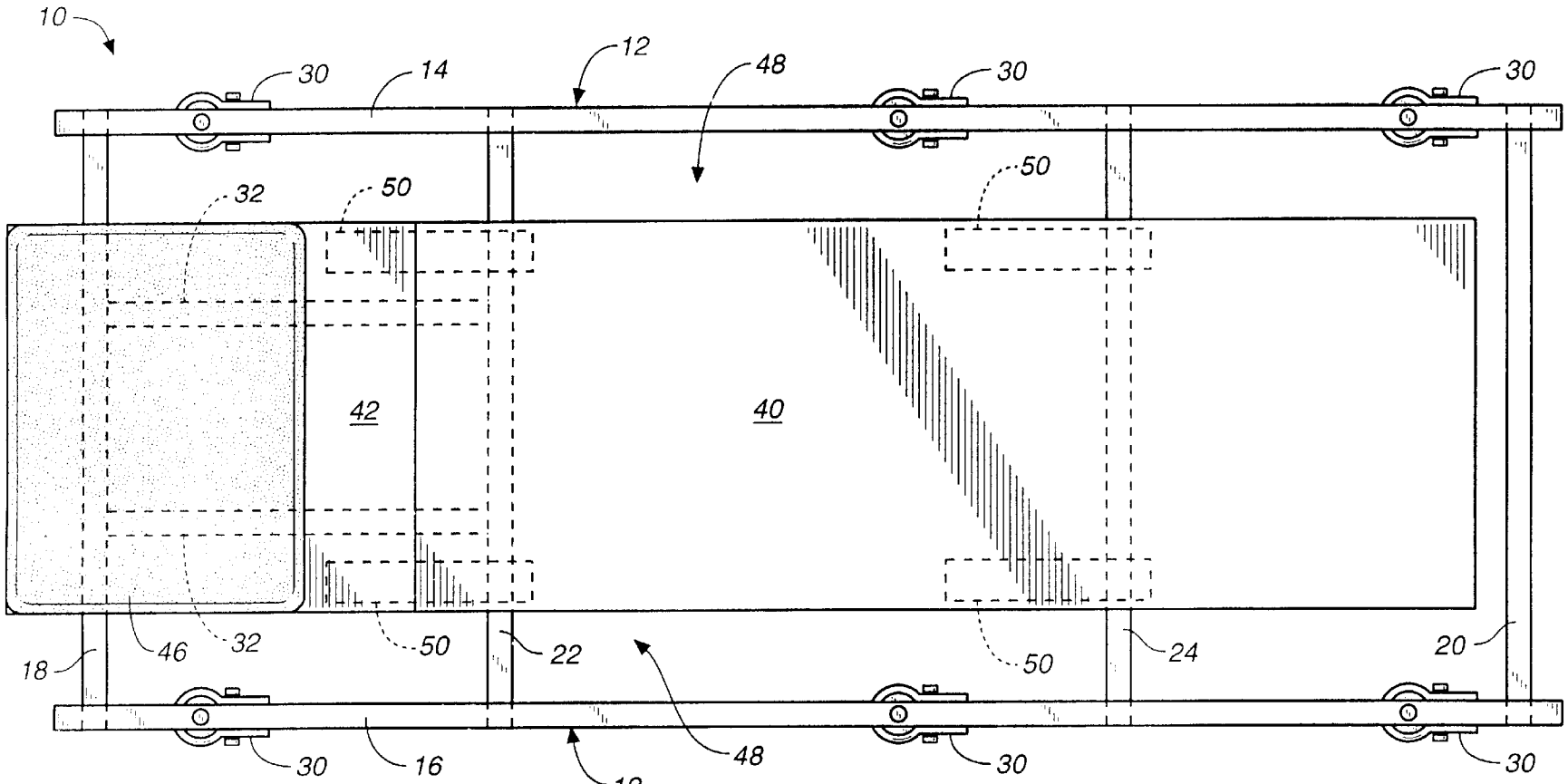
FIG. 2 is a top view of the creeper apparatus of FIG. 1.
Figure 3:
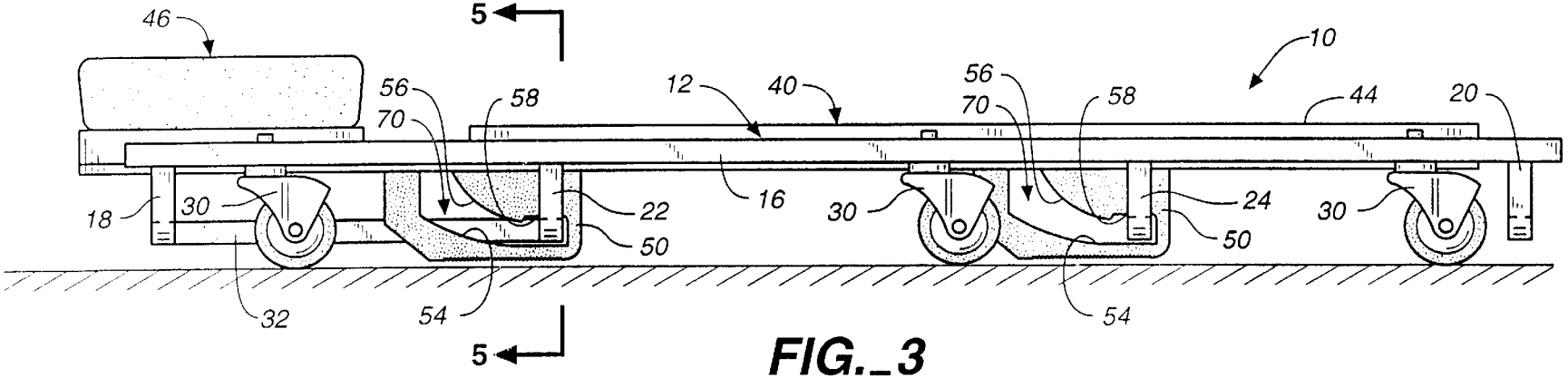
FIG. 3 is a side view of the creeper apparatus of FIG. 1.
Figure 6:
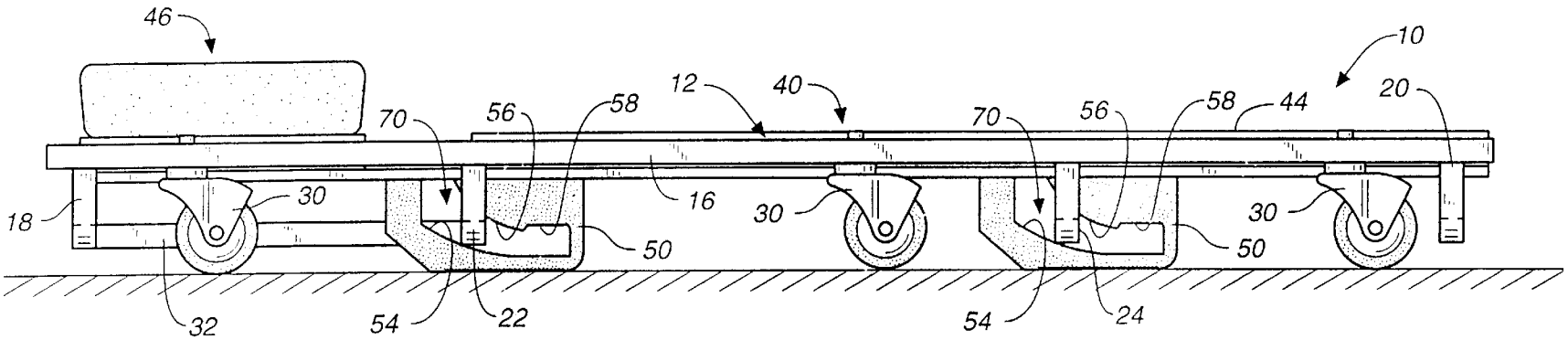
FIG. 6 is a side view like FIG. 3 of the frame and wheels in a raised position.

Referring to FIGS. 1 and 2, a set of four short, rectangular plastic creeper feet 50 are secured to the underside of base platform 42. Each creeper foot 50 is secured with one end 52 adjacent a cross bar 22, 24 and the other end toward headrest 46. A curved slot 54 is provided in each creeper foot 50 and the upper edge 56 of each slot 54 is formed as an arcuate surface with a slight rise 58 at its inner end. Slot 54 is sufficiently wide to accommodate a cross bar 22, 24 and allow for relative movement between the cross bar and the creeper foot.

Feet 50 act as brake devices for the creeper in order to hold the creeper stationary in position, as is discussed in more detail later. The cross bars 22, 24 act as cam followers as they engage and act against arcuate cam surface 56 in order to raise the pad assembly.

Figure 4:
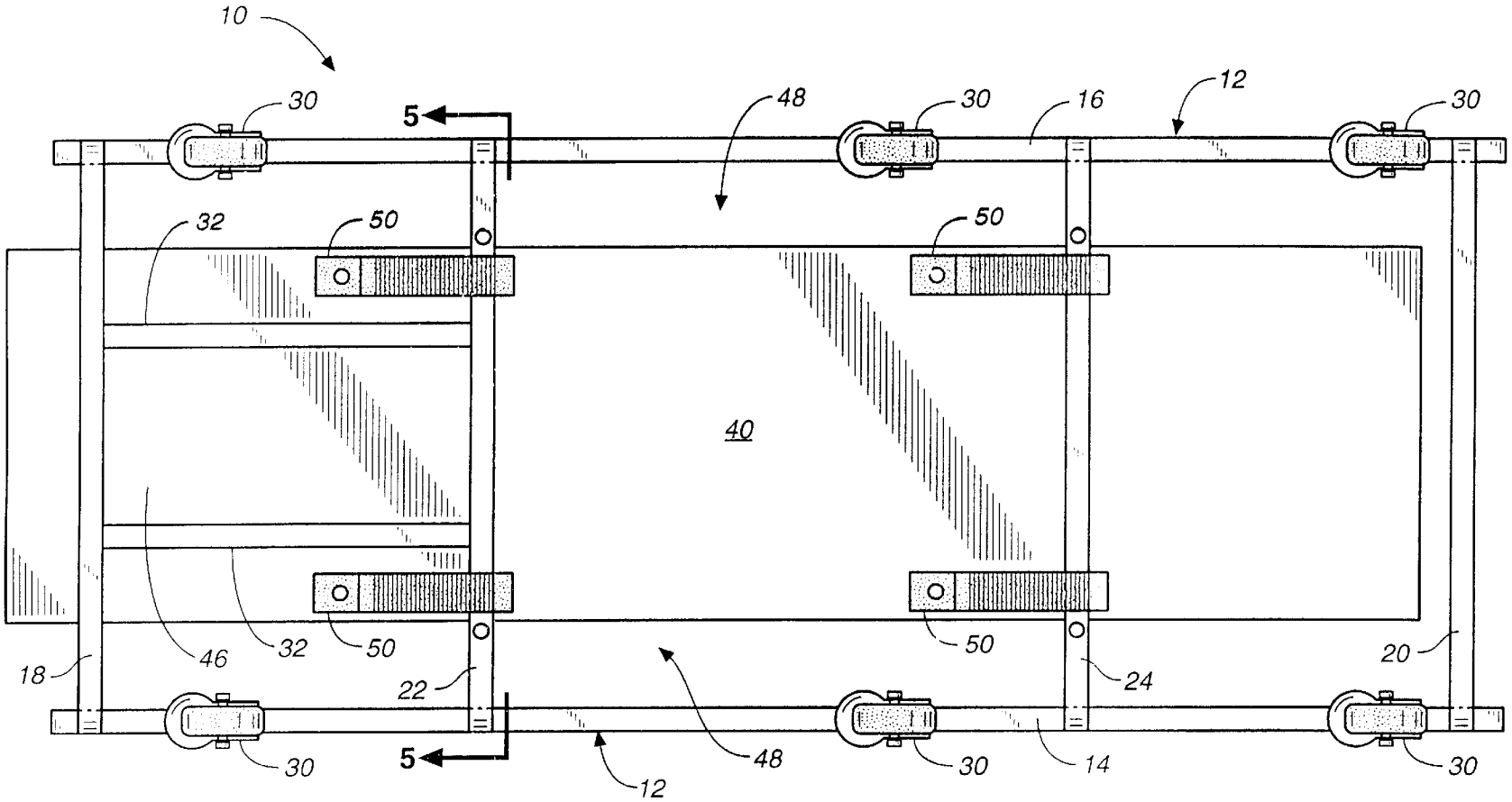
FIG. 4 is a bottom view of the creeper apparatus of FIG. 1.

In FIG. 4, it can be seen that a set of four stop rollers 59 are secured to the undersides of cross bars 22, 24 immediately laterally outside of creeper feet 50. Stop rollers 59 extend down from cross bars 22, 24 and engage the sides of creeper feet 50. The purpose of the stop rollers is to prevent lateral movement of the pad assembly and thereby limit movement of the pad assembly strictly to longitudinal movement relative to frame 12.

In FIG. 2, the creeper assembly is shown with frame 12 in a lowered position with caster wheels 30 supporting the creeper and with pad assembly 40 supported by cross bars 22, 24 at the slight rise 58 at the inner ends of slots 54 of creeper feet 50. This is the mobile position of the creeper wherein a person lying on the pad assembly can move the creeper around by controlling the creeper with the person's hands and feet.

To lock the creeper in position so that it does not move, a person lying on the pad assembly only needs to slide the pad assembly rearwardly in the direction of arrow 60 until creeper feet 50 engage the ground. As the pad assembly 40 is slid rearwardly, the arcuate cam surface 56 of each creeper foot moves over a cross arm 22, first rising slightly up and then downwardly until the creeper foot engages the ground. As the arcuate cam surface 56 moves over a cross arm, the weight of the pad assembly and of the person lying thereon assists in lowering the pad assembly until the feet hit the ground. As a result, it is not necessary for the person to generate additional force in order to lift the feet off the ground. The person's own weight is working as an advantage in braking the creeper.

After the creeper feet engage the ground, the pad assembly 40 stops its absolute movement but the frame 12 and wheels 30 move forwardly, allowing cross bars 22, to continue to move along arcuate cam surfaces 56 of the creeper feet until the wheels are unweighted and the entire weight of the creeper is transferred to the creeper feet. In practice, the entire weight of the creeper plus the person may not transfer to the feet, but a sufficient amount will transfer to provide enough frictional contact with the ground to prevent movement of the creeper.

To shift the weight of the creeper back onto the wheels, the person slides the frame forwardly, causing the cross bars 22, 24 to engage and act against arcuate cam surfaces 56 as they move down the arcuate surfaces until the wheels contact the ground. After the wheels hit the ground, further relative movement of the frame and the pad assembly causes the weight of the creeper to completely shift to the wheels and the cross arms to move into the slightly raised ends 58 of slots 54, which has the effect of holding the pad assembly in its raised position with creeper feet 50 above the ground. Thus, when the arcuate surfaces 56 and the cross bars 22, 24 are actively engaged, the feet are raised. Only when the cross bars move out of slots 54 do the cross bars disengage from the arcuate surfaces, allowing the feet to directly support the pad assembly.

Preferably, the undersides of the creeper feet are rough or include ridges to enhance traction of the creeper feet. It may be desirable to include handles on the frame that the person can grip while sliding the pad assembly rearwardly.

While a set of four creeper feet are shown as part of the pad assembly, a single creeper foot would be sufficient to brake the creeper apparatus and could be attached to the pad assembly at a central location. However, to properly balance the pad assembly when it bears the weight of the person lying on the pad, at least two and preferable four creeper feet are provided.

An advantage of the creeper assembly of the present invention is its compatibility with existing creeper equipment. Frame 12 and wheels 30 form a common creeper design used on many commercially available creepers. Pad assembly 40 can be retrofitted to many of these frame and wheel assemblies in order to achieve the improved easy to use creeper of the present invention. Each creeper foot 50 is formed with its slot 54 open at its upper end 70 so that during assembly of the creeper, the creeper foot can be slid over a cross bar 22, 24 and then secured to the underside of base platform 42.

In addition, for many types of creepers, the feet of the present invention can be retrofitted to both an existing pad assembly and frame structure. In this case, the pad assembly needs to be unbolted from the frame and then the creeper feet slid over the cross bars of the frame and mounted to the pad assembly. Retrofitting a set of four creeper feet to existing creepers has the advantage of simplicity of design, ease of modification, and low cost The plastic feet are easily replaced when worn or broken, so maintenance and replacement costs are also low.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the Claims appended hereto when read and interpreted according to accepted legal principles such as the doctrine of equivalents and reversal of parts.

What is claimed is:

1. A creeper apparatus comprising, a frame structure including a set of wheels for movably supporting the frame structure across a ground surface, a pad assembly coupled to the frame structure for substantially horizontal movement, the pad assembly including a support surface for the body of a person to lie on, a foot mounted to the pad assembly in a position to support the pad assembly upon engagement with the ground surface, a cam surface associated with one of the frame structure and the pad assembly, and a cam follower associated with the other of the frame structure and the pad assembly for engagement with the cam surface to support the pad assembly on the frame structure, whereby relative horizontal movement of the frame structure and the pad assembly causes disengagement of the cam surface and the cam follower, causing the weight of the pad assembly and the person lying thereon to cause the foot to engage the ground surface and sufficiently unweight the frame structure to hold the pad assembly stationary in place.

2. The apparatus of claim 1 wherein, the cam surface and cam follower are designed to raise and lower the pad assembly in a manner that the weight of the pad assembly and a person lying thereon act to lower the feet when the cam surface and cam follower are moved relative to one another.

3. The apparatus of claim 2 wherein, the cam surface and cam follower are aligned in a manner where the feet are raised when the cam surface and the cam follower are engaged and acting against one another.

4. The apparatus of claim 1 and further including stops to limit lateral movement of the pad assembly relative to the frame structure.

5. The apparatus of claim 1 wherein, the frame structure and the pad assembly are movable relative to each other from a first position to a second position, and wherein in the first position, the frame structure supports the assembly with the foot of the pad assembly spaced above the ground surface, and in the second position, the foot engages the ground with sufficient force to maintain the pad assembly stationary in position.

6. A brake device for a creeper apparatus that includes a frame structure with a set of wheels for movably supporting the frame structure across a ground surface and a pad assembly coupled to the frame structure for substantially horizontal movement, and having a support surface for the body of a person to lie on, the brake device comprising:

a foot for mounting to the pad assembly in a position to support the pad assembly upon engagement with the ground surface, a cam surface associated with one of the frame structure and the pad assembly, and a cam follower associated with the other of the frame structure and the pad assembly for engagement with the cam surface to support the pad assembly on the frame structure, whereby relative horizontal movement of the first and second frame structures causes disengagement of the cam surface and the cam follower, causing the weight of the pad assembly and the person lying thereon to cause the foot to engage the ground surface and sufficiently unweight the frame structure to hold the pad assembly stationary in place.

7. The brake device of claim 6 wherein, the cam surface and cam follower are designed to raise and lower the pad assembly in a manner that the weight of the pad assembly and a person lying thereon act to lower the feet when the cam surface and cam follower are moved relative to one another.

8. The apparatus of claim 7 wherein, the cam surface and cam follower are aligned in a manner where the feet are raised when the cam surface and the cam follower are engaged and acting against one another.

9. The apparatus of claim 6 and further including stops to limit lateral movement of the pad assembly relative to the frame structure.

10. A method of braking a creeper apparatus with a person lying thereon, comprising the steps of:

supporting the person on a pad assembly that is carried on a frame structure that is movably supported on a ground surface, the pad assembly including a cam surface for engaging a cam follower mounted to the frame structure to support the pad assembly on the frame structure, moving a pad assembly relative to a frame structure to cause relative longitudinal movement therebetween, in order to disengage the cam follower from the cam surface, as the pad assembly and frame structure are moved relative to one another, lowering the pad assembly by use of its own weight and the weight of a person lying thereon until the foot engages the ground and sufficiently unweights the frame structure to hold the pad assembly in position.

* * * * *

UNITED STATES PATENT AND TRADEMARK OFFICE

CERTIFICATE OF CORRECTION

PATENT NO. : 6,076,838
DATED : June 20, 2000
INVENTOR(S) : Peterson et al.

It is certified that error appears in the above-identified patent and that said Letters Patent is hereby corrected as shown below:

Column 1,
Line 22, delete “carnring” and insert therefor -- camming --.
Line 23, delete “rengagement” and insert therefor -- engagement --.

Signed and Sealed this

Tenth Day of September, 2002

*Attest:*

*Attesting Officer*

JAMES E. ROGAN
*Director of the United States Patent and Trademark Office*